US010065754B2

(12) United States Patent
Khubani et al.

(10) Patent No.: US 10,065,754 B2
(45) Date of Patent: Sep. 4, 2018

(54) CONTAINER SEALING DEVICE

(71) Applicant: Telebrands Corp., Fairfield, NJ (US)

(72) Inventors: Ajit Khubani, Saddle River, NJ (US); Paul Dowd, Scarsdale, NY (US); Ryan Kelly, Yorktown Heights, NY (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 15/722,930

(22) Filed: Oct. 2, 2017

(65) Prior Publication Data

US 2018/0022481 A1 Jan. 25, 2018

Related U.S. Application Data

(63) Continuation of application No. 15/407,985, filed on Jan. 17, 2017, now Pat. No. 9,776,744, which is a (Continued)

(51) Int. Cl.

| | |
|---|---|
| ***B65B 1/04*** | (2006.01) |
| ***B65B 3/17*** | (2006.01) |
| ***B65B 7/02*** | (2006.01) |

(52) U.S. Cl.

CPC ..... *B65B 3/17* (2013.01); *B65B 7/025* (2013.01)

(58) Field of Classification Search

CPC ..... A61B 10/0045; A63H 27/10; A63H 2027/1033; A63H 2027/1041;

(Continued)

(56) References Cited

U.S. PATENT DOCUMENTS

| | | | |
|---|---|---|---|
| 600,967 | A | 3/1898 | Mead |
| 723,292 | A | 3/1903 | Metzger |

(Continued)

FOREIGN PATENT DOCUMENTS

| | | |
|---|---|---|
| CN | 201161115 | 12/2008 |
| CN | 201710967 | 1/2011 |

(Continued)

OTHER PUBLICATIONS

Air Force 4 Inflator, available at www.conwinonline.com, published Jun. 9, 2013.

(Continued)

*Primary Examiner* — Jason K Niesz
(74) *Attorney, Agent, or Firm* — Cooper & Dunham, LLP

(57) ABSTRACT

An apparatus for filling a plurality of containers with a fluid. The apparatus including a connector configured to removably couple the apparatus to a fluid source, a flow path providing fluid communication between the fluid source and a plurality of containers coupled to the apparatus, a sealing element disposed within each of the plurality of containers, the sealing element configured to couple the container to the apparatus and automatically seal the container when the container is decoupled from the apparatus, a retaining member including a sleeve affixed to each of the plurality of containers, to position the sealing element in a neck of each of the plurality of containers, the sleeve being configured to prevent radial expansion of the containers, and, a mixing mechanism disposed in the flow path and configured to receive an additive and introduce the additive in to the flow path.

5 Claims, 9 Drawing Sheets

Related U.S. Application Data continuation-in-part of application No. 15/359,134, filed on Nov. 22, 2016, now Pat. No. 9,783,327, which is a continuation-in-part of application No. 15/123,434, filed as application No. PCT/US2016/018912 on Feb. 22, 2016, which is a continuation of application No. 14/997,230, filed on Jan. 15, 2016, now abandoned, said application No. 15/359,134 is a continuation-in-part of application No. 15/123,453, filed as application No. PCT/US2016/018922 on Feb. 22, 2016, which is a continuation of application No. 14/978,839, filed on Dec. 22, 2015, now abandoned.

(60) Provisional application No. 62/254,487, filed on Nov. 12, 2015, provisional application No. 62/182,122, filed on Jun. 19, 2015, provisional application No. 62/182,122, filed on Jun. 19, 2015.

(58) Field of Classification Search
CPC ..... A63H 2027/105; B65B 3/17; B65B 3/04; B65B 3/28; B65B 7/025
See application file for complete search history.

(56) References Cited

U.S. PATENT DOCUMENTS

| | | | |
|---|---|---|---|
| 1,832,408 | A | 11/1931 | Modes |
| 2,797,132 | A | 6/1957 | Max |
| 3,580,303 | A | 5/1971 | Roberge |
| 3,948,259 | A | 4/1976 | Bolduc |
| 4,142,322 | A | 3/1979 | Zeyra |
| 4,243,220 | A | 1/1981 | Shelley |
| 4,327,734 | A | 5/1982 | White |
| 4,471,779 | A | 9/1984 | Antoshkiw |
| 4,529,018 | A | 7/1985 | Lichfield |
| 4,545,367 | A | 10/1985 | Tucci |
| RE32,348 | E | 2/1987 | Pevsner |
| 4,794,498 | A | 12/1988 | Neumeier |
| 4,850,912 | A | 7/1989 | Koyanagi |
| 4,917,646 | A | 4/1990 | Kieves |
| 4,955,412 | A | 9/1990 | Younts |
| 5,004,633 | A | 4/1991 | Lovik |
| 5,014,757 | A | 5/1991 | Donaldson |
| 5,067,301 | A | 11/1991 | Shore |
| 5,165,393 | A | 11/1992 | Kawaguchi |
| 5,188,558 | A | 2/1993 | Barton |
| 5,295,892 | A | 3/1994 | Felton |
| 5,304,123 | A | 4/1994 | Atala |
| 5,439,199 | A | 8/1995 | Briggs |
| 5,496,203 | A | 3/1996 | Murray |
| 5,509,540 | A | 4/1996 | Pomerantz |
| 5,544,466 | A | 8/1996 | Bonnet |
| D378,120 | S | 2/1997 | Wood |
| 5,711,691 | A | 1/1998 | Damask |
| 5,730,366 | A | 3/1998 | DeWitt |
| 5,755,419 | A | 5/1998 | Gearhart |
| 5,776,291 | A | 7/1998 | Lang |
| 5,826,803 | A | 10/1998 | Cooper |
| 6,007,403 | A | 12/1999 | Urspringer |
| 6,106,135 | A | 8/2000 | Zingale |
| 6,106,509 | A | 8/2000 | Loubser |
| 6,192,917 | B1 | 2/2001 | Loza |
| 6,408,902 | B1 | 6/2002 | Liau |
| 6,431,938 | B1 | 8/2002 | Carlton |
| 6,478,057 | B1 | 11/2002 | Bearss |
| 6,478,651 | B1 | 11/2002 | Weir |
| 6,479,776 | B2 | 11/2002 | Nakase |
| 6,488,557 | B1 | 12/2002 | Elliot |
| 6,719,020 | B1 | 4/2004 | Bisotto |
| 7,160,325 | B2 | 1/2007 | Morningstar |
| 7,293,477 | B2 | 11/2007 | Furey |
| D619,202 | S | 7/2010 | Zhang |
| 7,981,470 | B1 | 7/2011 | Butler |
| 8,037,906 | B1 | 10/2011 | Grillo |
| 8,349,417 | B2 | 1/2013 | Heffernan |
| 8,479,776 | B2 | 7/2013 | Berardi |
| 8,789,565 | B1 | 7/2014 | Wicken |
| 9,051,066 | B1 | 6/2015 | Malone |
| 9,174,141 | B2 | 11/2015 | Warner |
| 9,242,749 | B2 | 1/2016 | Malone |
| 9,315,282 | B2 | 4/2016 | Malone |
| 9,481,477 | B2 | 11/2016 | Kjar |
| 9,524,105 | B2 | 12/2016 | Samuels |
| 9,527,612 | B2 | 12/2016 | Malone |
| 9,533,779 | B2 | 1/2017 | Malone |
| D793,483 | S | 8/2017 | Khubani |
| D793,484 | S | 8/2017 | Khubani |
| D793,485 | S | 8/2017 | Khubani |
| 9,776,744 | B2 | 10/2017 | Khubani |
| 9,783,327 | B2 | 10/2017 | Khubani |
| 9,844,737 | B1 | 12/2017 | Warner |
| 2004/0233674 | A1 | 11/2004 | Vanderschuit |
| 2005/0004430 | A1 | 1/2005 | Lee |
| 2005/0132821 | A1 | 6/2005 | Furey |
| 2005/0138862 | A1 | 6/2005 | O'Connor |
| 2006/0272432 | A1 | 12/2006 | Belongia |
| 2008/0029099 | A1 | 2/2008 | Storz |
| 2008/0121309 | A1 | 5/2008 | Boise |
| 2008/0166943 | A1 | 7/2008 | Hou |
| 2008/0195226 | A1 | 8/2008 | Williams |
| 2009/0050835 | A1 | 2/2009 | Boise |
| 2009/0130948 | A1 | 5/2009 | James |
| 2010/0014378 | A1 | 1/2010 | Strahmann |
| 2010/0255226 | A1 | 10/2010 | Heffernan |
| 2010/0319796 | A1 | 12/2010 | Whitaker |
| 2010/0326212 | A1 | 12/2010 | Furey |
| 2011/0030847 | A1 | 2/2011 | Wang |
| 2011/0253256 | A1 | 10/2011 | Finley |
| 2012/0085461 | A1 | 4/2012 | Coker |
| 2012/0256012 | A1 | 10/2012 | Posner |
| 2012/0326212 | A1 | 12/2012 | Fompeyrine |
| 2013/0118640 | A1 | 5/2013 | Saggio |
| 2013/0186972 | A1 | 7/2013 | Petrovic |
| 2013/0226219 | A1 | 8/2013 | Brister |
| 2013/0240082 | A1 | 9/2013 | Mueller |
| 2014/0030452 | A1 | 1/2014 | Warner |
| 2014/0073990 | A1 | 3/2014 | Holmes |
| 2014/0360626 | A1 | 12/2014 | Stieler |
| 2015/0259085 | A1 | 9/2015 | Malone |
| 2016/0083122 | A1 | 3/2016 | Malone |
| 2016/0101367 | A1 | 4/2016 | Walz |
| 2016/0243454 | A1 | 8/2016 | Laden |

FOREIGN PATENT DOCUMENTS

| | | |
|---|---|---|
| CN | 204293867 | 4/2015 |
| DE | 29800591 | 3/1998 |
| EP | 0609386 | 9/1996 |
| FR | 2546069 | 11/1984 |
| FR | 2606393 | 11/1986 |
| FR | 2911512 | 7/2008 |
| FR | 2955036 | 7/2011 |
| GB | 2369307 | 5/2002 |
| JP | S6182080 | 4/1986 |
| JP | 3153581 | 9/2009 |
| JP | 2010023857 | 2/2010 |
| JP | 2011162208 | 8/2011 |
| WO | WO 87/02438 | 4/1987 |
| WO | WO 90/00430 | 1/1990 |
| WO | WO2013123067 | 8/2013 |
| WO | WO 2014022248 | 2/2014 |
| WO | WO 2015/027187 | 2/2015 |
| WO | WO 2015/118518 | 8/2015 |

OTHER PUBLICATIONS

Petition for Post Grant Review of U.S. Pat. No. 9,315,282, filed on Aug. 12, 2016 (PGR2016-00031).

Declaration of Dr. Ken Kamrin dated Aug. 11, 2016 submitted in support of Petition for Post Grant Review of U.S. Pat. No. 9,315,282, filed on Aug. 12, 2016 (PGR2016-00031).

(56) References Cited

OTHER PUBLICATIONS

Declaration of Dr. Ken Kamrin dated Aug. 7, 2016, submitted in support of Petition for Post Grant Review of U.S. Pat. No. 9,242,749, filed on Aug. 8, 2016 (PGR2016-00030).
Final Written Decision of PGR2015-00018, entered on Dec. 30, 2016.
Jun. 21, 2016 Extended European Search Report issued in connection with Application No. 15158482.8, issued by the European Patent Office.
Petition for Post Grant Review of U.S. Pat. No. 9,242,749, filed on Aug. 8, 2016 (PGR2016-00030).
Decision Instituting Post Grant Review of U.S. Pat. No. 9,315,282, entered on Feb. 21, 2017.
Decision Instituting Post Grant Review of U.S. Pat. No. 9,242,749, entered on Feb. 21, 2017.
Examination Report for Australian Patent Application No. 2016100289, dated Oct. 25, 2016.
Written Opinion of International Search Authority PCT/US2016/018922, published May 2, 2016.
International Search Report PCT/US2016/018922, published May 2, 2016.
Written Opinion of International Search Authority PCT/US2016/018912, published Apr. 22, 2016.
Jun. 29, 2016 Non-Final Office Action issued in connection with U.S. Appl. No. 14/978,839.
Jun. 9, 2016 Non-Final Office Action issued in connection with U.S. Appl. No. 14/997,230.
Jul. 21, 2016 Non-Final Office Action issued in connection with U.S. Appl. No. 15/177,796.
International Search Report PCT/US2016/018912, published Apr. 22, 2016.
Water Balloon Paint War, available at http://www.growingajeweledrose.com/2013/07/water-balloon-paint-war.html, accessed on Dec. 27, 2015.
Colorful Water Balloon Fights, available at http://rundrenched.com/introducing-the-most-colorful-water-balloon-fight-in-the-world/, accessed on Dec. 27, 2015.
Making Paint Balloons, available at http://learn.walmart.com/Tips-Ideas/Articles/Summer_Gatherings/25392/, accessed on Dec. 27, 2015.
Examination Report for Australian Patent Application No. 2016100289, dated May 20, 2016.
Written Opinion of International Search Authority PCT/US17/13783, published Apr. 14, 2017.
Examination Report for Australian Patent Application No. 2016102136, dated Mar. 7, 2017.
Examination Report for Australian Patent Application No. 2016102137, dated Mar. 7, 2017.
Examination Report for Australian Patent Application No. 2016102138, dated Mar. 9, 2017.
International Search Report PCT/US17/13783, published Apr. 14, 2017.
U.S. Appl. No. 14/978,839, filed Dec. 22, 2015.
U.S. Appl. No. 14/997,230, filed Jan. 15, 2016.
U.S. Appl. No. 15/177,796, filed Jun. 9, 2016.
U.S. Appl. No. 15/123,434, filed Sep. 2, 2016.
U.S. Appl. No. 15/123,453, filed Sep. 8, 2016.
Decision Denying Institution of Post Grant Review of U.S. Pat. No. 9,533,779 entered on Nov. 30, 2017.
Decision Instituting Post Grant Review of U.S. Pat. No. 9,527,612 entered on Oct. 11, 2017.
Petition for Post Grant Review of U.S. Pat. No. 9,682,789, filed on Jul. 21, 2017 (PGR2017-00040).
Petition for Post Grant Review of U.S. Pat. No. 9,533,779, filed on Sep. 12, 2017 (PGR2017-00052).
Petition for Post Grant Review of U.S. Pat. No. 9,527,612 filed on Mar. 22, 2017 (PGR2017-00015).
Petition for Post Grant Review of U.S. Pat. No. 9,527,612, filed on Sep. 12, 2017 (PGR2017-00051).
Petition for Post Grant Review of U.S. Pat. No. 9,533,779, filed on May 23, 2017 (PGR2017-00024).
Petition for Post Grant Review of U.S. Pat. No. 9,051,066, filed on Jun. 22, 2015 (PGR2015-00018).
Decision Instituting Post Grant Review of U.S. Pat. No. 9,051,066, entered on Jan. 4, 2016 (PGR2015-00018).
Noodlehead Sprinkler, copyrighted 2010.
Zorbz Replicator, available at https://www.youtube.com/watch?v=wCajj0KPV7c, accessed on Aug. 19, 2014.
Declaration of Dr. Ken Kamrin dated Jun. 21, 2015, submitted in support of Petition for Post Grant Review of U.S. Pat. No. 9,051,066, filed on Jun. 22, 2015 (PGR2015-00018).
Declaration of Dr. Greg Saggio dated Jun. 18, 2015, submitted in support of Petition for Post Grant Review of U.S. Pat. No. 9,051,066, filed on Jun. 22, 2015 (PGR2015-00018).
Declaration of Kendall Harter dated Jun. 17, 2015, submitted in support of Petition for Post Grant Review of U.S. Pat. No. 9,051,066, filed on Jun. 22, 2015 (PGR2015-00018).
Bunch O Balloons, available at bunchoballoons.com, copyrighted 2015, accessed in Jun. 2015.
This Simple Contrapation Lets You Make 100 Water Balloons Every Minute, Gizmodo, available at http://gizmodo.com/, published Jul. 2014.
Examination Report for Australian Patent Application No. 2016100290, dated May 20, 2016.
European Patent Office European Search Report of Application No. 16788004, dated Jan. 4, 2018.
European Patent Office European Search Report of Application No. 16788005, dated Jan. 4, 2018.

CONTAINER SEALING DEVICE

CROSS REFERENCE TO PRIOR APPLICATIONS

The present application is a continuation application of U.S. application Ser. No. 15/407,985, filed on Jan. 17, 2017, which is a continuation-in-part application of U.S. application Ser. No. 15/359,134, filed on Nov. 22, 2016, which is a continuation-in-part of U.S. application Ser. No. 15/123,434, filed on Sep. 2, 2016, which is a U.S. National Stage Application of International Application No. PCT/US16/18912, filed on Feb. 22, 2016, which claims the benefit of U.S. Provisional Application No. 62/182,122, filed on Jun. 19, 2015, U.S. Provisional Application No. 62/254,487, filed on Nov. 12, 2015, and U.S. application Ser. No. 14/997,230, filed on Jan. 15, 2016. U.S. application Ser. No. 15/359,134, filed on Nov. 22, 2016, is also a continuation-in-part of U.S. application Ser. No. 15/123,453, filed on Sep. 2, 2016, which is a U.S. National Stage Application of International Application No. PCT/US16/18922, filed on Feb. 22, 2016, which claims the benefit of U.S. Provisional Application No. 62/182,122, filed on Jun. 19, 2015, and U.S. application Ser. No. 14/978,839, filed on Dec. 22, 2015. These applications are incorporated by reference herein in their entireties.

FIELD

The present application generally relates to devices, apparatus, systems and methods for filling containers with a fluid. Specifically, the present application relates to automatically filling multiple balloons with a fluid mixture.

BACKGROUND

Some containers, particularly fluid-inflatable containers such as balloons, can be difficult to fill with a fluid, especially when there is a need to fill multiple containers simultaneously and/or quickly. To make the filling of these containers easier and more efficient, various products are currently available that facilitate the filling of fluid-inflatable containers. These fluid-inflatable containers may be filled or inflated using various fluids, such as, e.g., liquids such as water, gases such as helium, or medications. Examples of fluid-inflatable containers include those used for recreational purposes, such as balloons.

Additionally, there may be times where it may be desirable to be able to introduce an additive, such as a dye or other soluble or insoluble material, to the fluid used to fill the fluid-inflatable containers. Nevertheless, it may be difficult, impossible, inefficient, or undesirable to first mix the fluid with the additive and subsequently fill the containers with the mixture. Further, many of the existing products may connect directly to a fluid source, such as a hose or faucet, thereby making it impracticable to pour a mixture to fill fluid-inflatable containers using such products.

SUMMARY

Embodiments of the present invention can provide an apparatus for filling a plurality of containers with a fluid. The apparatus can include a connector configured to removably couple the apparatus to a fluid source, a flow path providing fluid communication between the fluid source and a plurality of containers coupled to the apparatus, a sealing element disposed within each of the plurality of containers, the sealing element configured to couple the container to the apparatus and automatically seal the container when the container is decoupled from the apparatus, a retaining member including a sleeve affixed to each of the plurality of containers, to position the sealing element in a neck of each of the plurality of containers, the sleeve being configured to prevent radial expansion of the containers, and a mixing mechanism disposed in the flow path and configured to receive an additive and introduce the additive in to the flow path.

According to some embodiments, the plurality of containers can include balloons and the apparatus can be resuable. According to certain exemplary embodiments, the plurality of fluid conduits are substantially the same length.

According to some embodiments, the additive may be a pellet, a powder, or a gel.

DETAILED DESCRIPTION

Embodiments of the present invention are generally directed to devices, apparatus, systems, and methods for filling containers with a fluid. Specifically, embodiments of the present invention provide an apparatus for filling multiple balloons at substantially the same time. Certain embodiments of the present invention facilitate introducing an additive to a fluid source to enable automatic filling of multiple containers in a substantially simultaneously manner with a fluid mixture. Although the embodiments of the present invention are primarily described with respect to dyes and fluid-inflatable containers, it is not limited thereto, and it should be noted that the apparatus and systems described herein may be used to fill any type of containers with any type of fluid and/or fluid mixture.

Figure 1A:
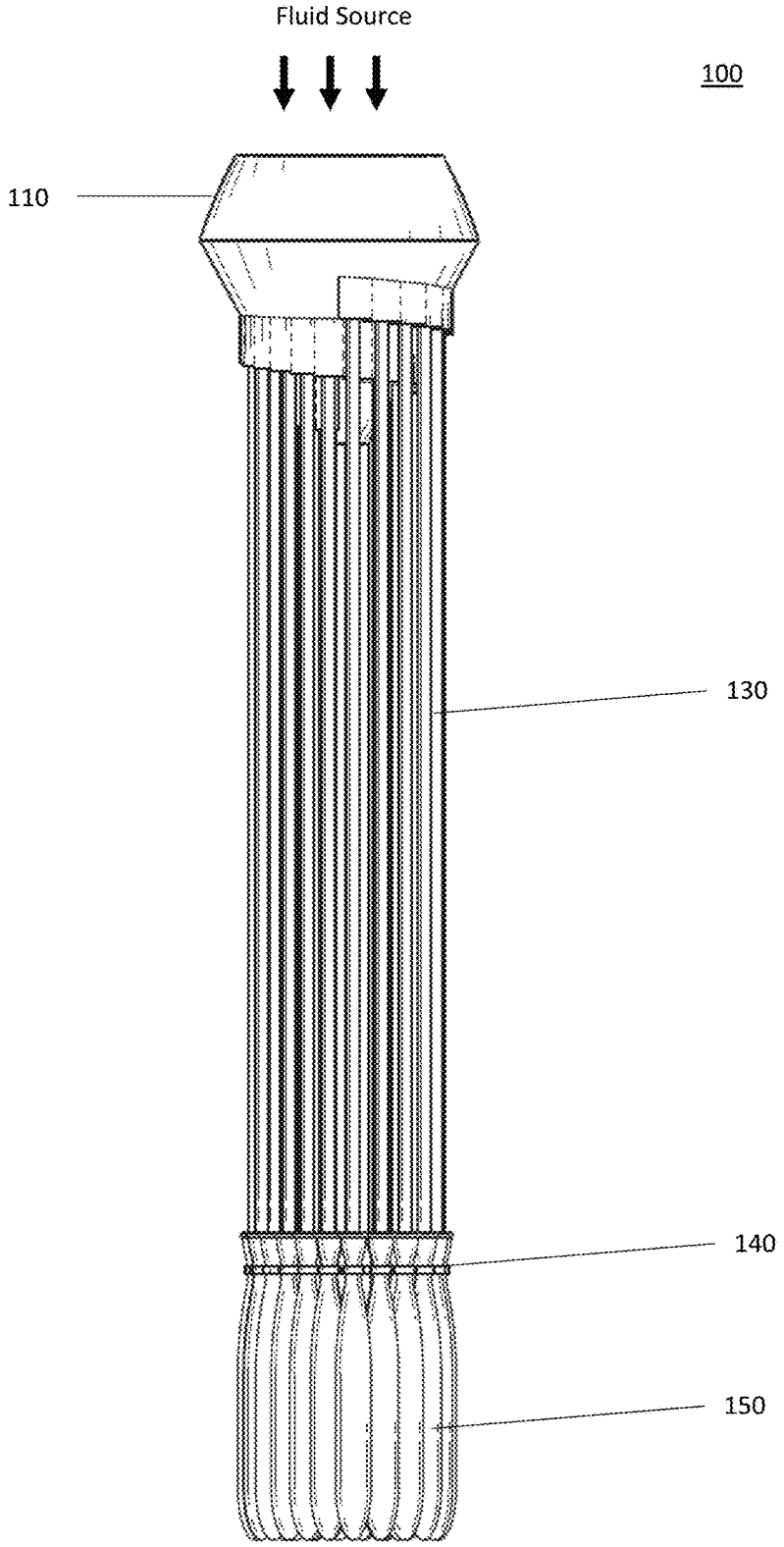
FIG. 1A is an illustration of an exemplary fluid filling apparatus according to embodiments of the present invention.

In accordance with embodiments of the present invention, FIG. 1A shows an exemplary fluid filling apparatus 100. As shown in FIG. 1A, fluid filling apparatus 100 may include connector 110, conduits 130, containers 150, and sealing elements 140. In use, fluid filling apparatus 100 is coupled to a fluid source, and when the fluid source is activated, the fluid passes through connector 110, conduits 130 and into containers 150, thereby filling containers 150 with the fluid at substantially the same time. Optionally, connector 110 may include an additive which may mix with the fluid as the fluid is passing through connector 110 so that containers 150 are filled with a mixture of the fluid and the additive. The fluid used to fill containers 150 may include any type of fluid, such as, water and other liquids, as well as helium and other gases.

Figure 1B:
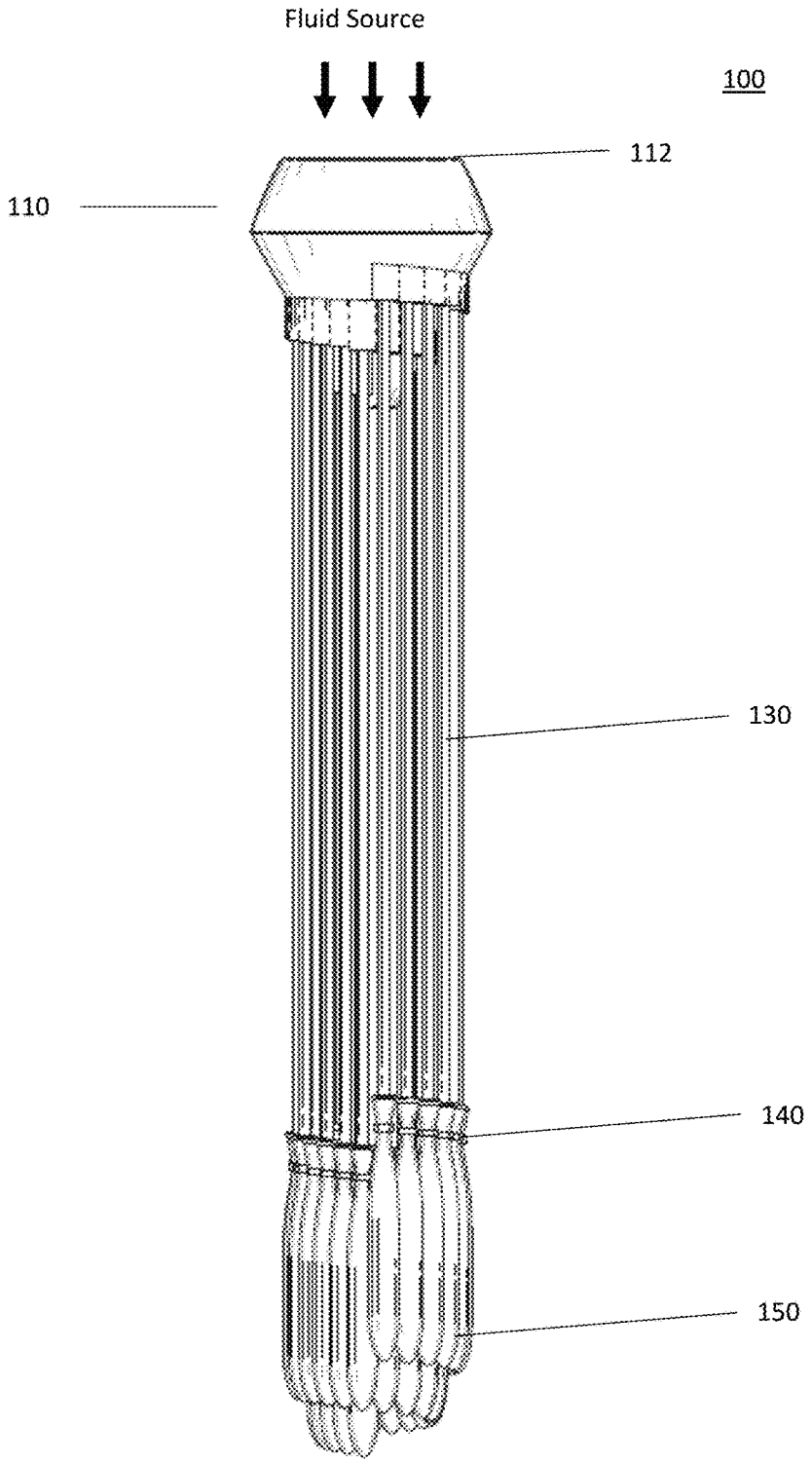
FIG. 1B is an illustration of an exemplary fluid filling apparatus according to embodiments of the present invention.

FIG. 1B shows another embodiment of the present invention. As shown in FIG. 1B, certain embodiments of the present invention provide a fluid filling apparatus 100 having conduits 130 which are arranged such that the distal end of conduits 130 (e.g., the end of conduit 130 furthest from connector 110) are disposed at different distances from a first end 112 of connector 110. Accordingly, each distal end may be disposed at a respective distance from first end 112 of connector 110 and all the respective distances may be different. For example, as shown in FIG. 1B, conduits 130 and containers 150 may be arranged in a cascading spiraling arrangement, where the distal end of each conduit 130 is disposed at a different distance from first end 112 of connector 110. Although a cascading spiraling arrangement is shown in FIG. 1B, conduits 130 may take be arranged in any arrangement. For example, conduits 130 and containers 150 may be arranged in any arrangement or pattern in which the distal end of each conduit 130 is disposed at a different distance from first end 112 of connector 110. Alternatively, conduits 130 may be arranged in a sequential arrangement such as, e.g., a zig-zag pattern, a linear pattern, an arcing pattern, a shaped pattern (e.g., a star shape, a moon shape, a rectangle, a square, a circle, a triangle, etc.). According to one embodiment, when conduits 130 are arranged in a sequential arrangement, the distance from the distal end of a given conduit 130 to first end 112 of connector 110 may be greater than the distance from the distal end of the preceding conduit to first end 112 of connector 110. Additionally, although the distal end of conduits 130 are disposed at different distances from a first end 112 of connector 110, conduits 130 may all be substantially the same length. This may be achieved, for example, by coupling conduits 130 at different distances from first end 112 within connector 110.

According to embodiments of the present invention, sealing elements 140 may be self-sealing. For example, sealing elements 140 may automatically seal containers 150 when containers 150 are decoupled from fluid filling apparatus 100. This may be accomplished when the force that each sealing element 140 exerts in coupling each respective container 150 to fluid filling apparatus 100 is overcome. This may be accomplished, for example, by the weight and/or pressure each container 150 exceeding a certain threshold thereby causing the container to become detached from the conduits 130, manual removal of the containers 150, or some other action, such as shaking fluid filling apparatus 100, to remove containers 150 from fluid filling apparatus 100. As this force is overcome, the respective container is detached from fluid filling apparatus 100, and sealing elements 140 automatically seal the end of respective container 150 that was attached to fluid filling apparatus 100. According to certain exemplary embodiments of the present invention, containers 150 may include balloons.

According to certain exemplary embodiments of the present invention, sealing elements 140 may include a mechanism by which the containers are automatically sealed when they are detached from fluid filling apparatus 100. For example, sealing elements 140 can include rubber bands or clamps, which simply clamp and/or seal the containers by exerting a compressive force around a neck of containers 150. Alternatively, sealing elements 140 can include other mechanisms to seal containers 150. For example, sealing elements 140 can include a liquid-activated material positioned in the neck of containers 150 that are configured to expand and seal the neck of containers 150 when a fluid such as water is introduced to containers 150. Alternatively, sealing elements 140 can include a self-healing membrane positioned in the neck of containers 150, such as a closed-cell foam, that allow conduits 130 to be inserted therethrough, and self-heals when conduit 130 is removed so as to seal container 150. According to certain exemplary embodiments of the present invention, sealing elements 140 can also include a valve as shown in FIGS. 2A-2C.

Figure 2A:
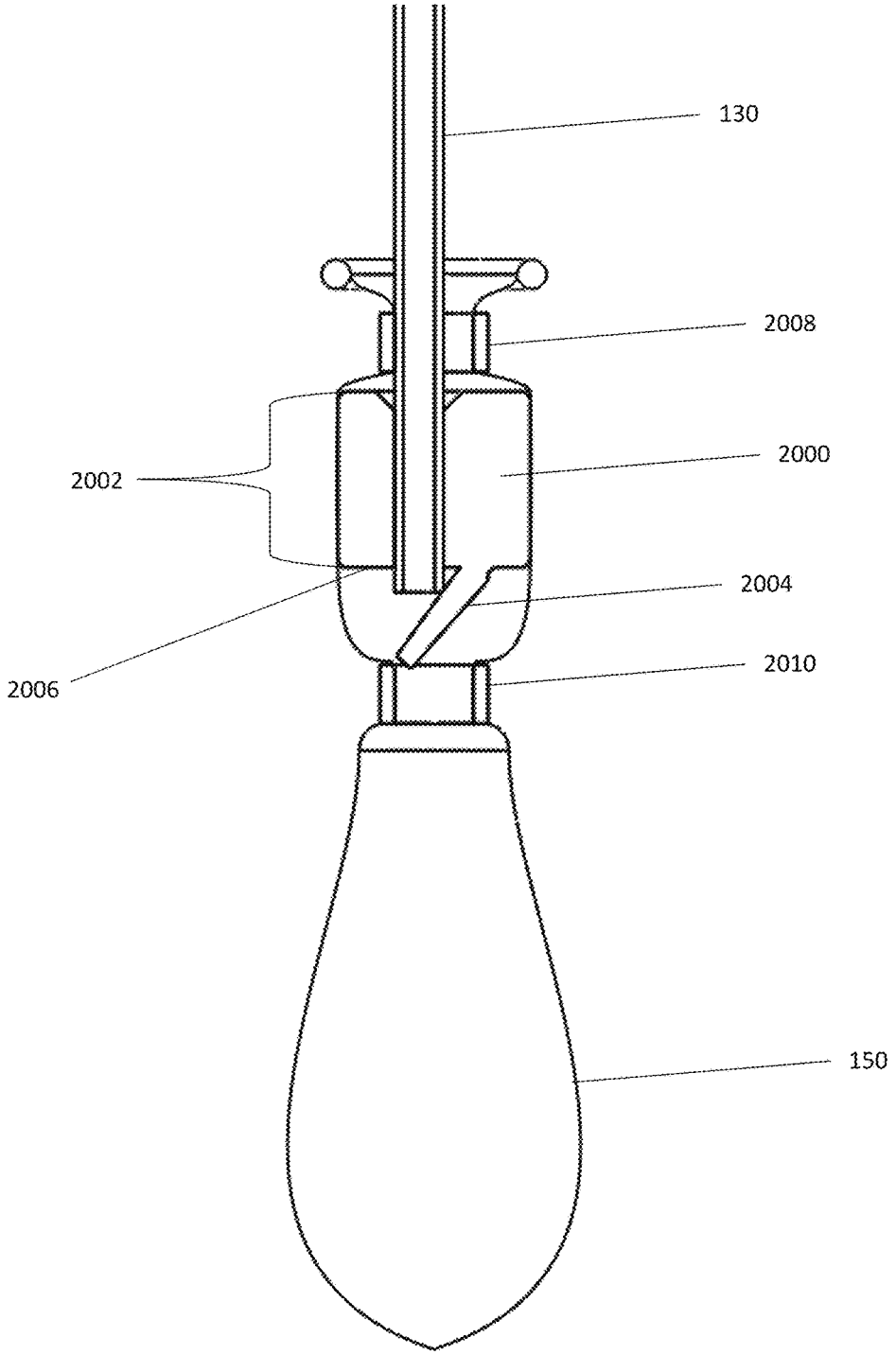
FIGS. 2A-2C are illustrations of exemplary sealing elements according to embodiments of the present invention.
Figure 2B:
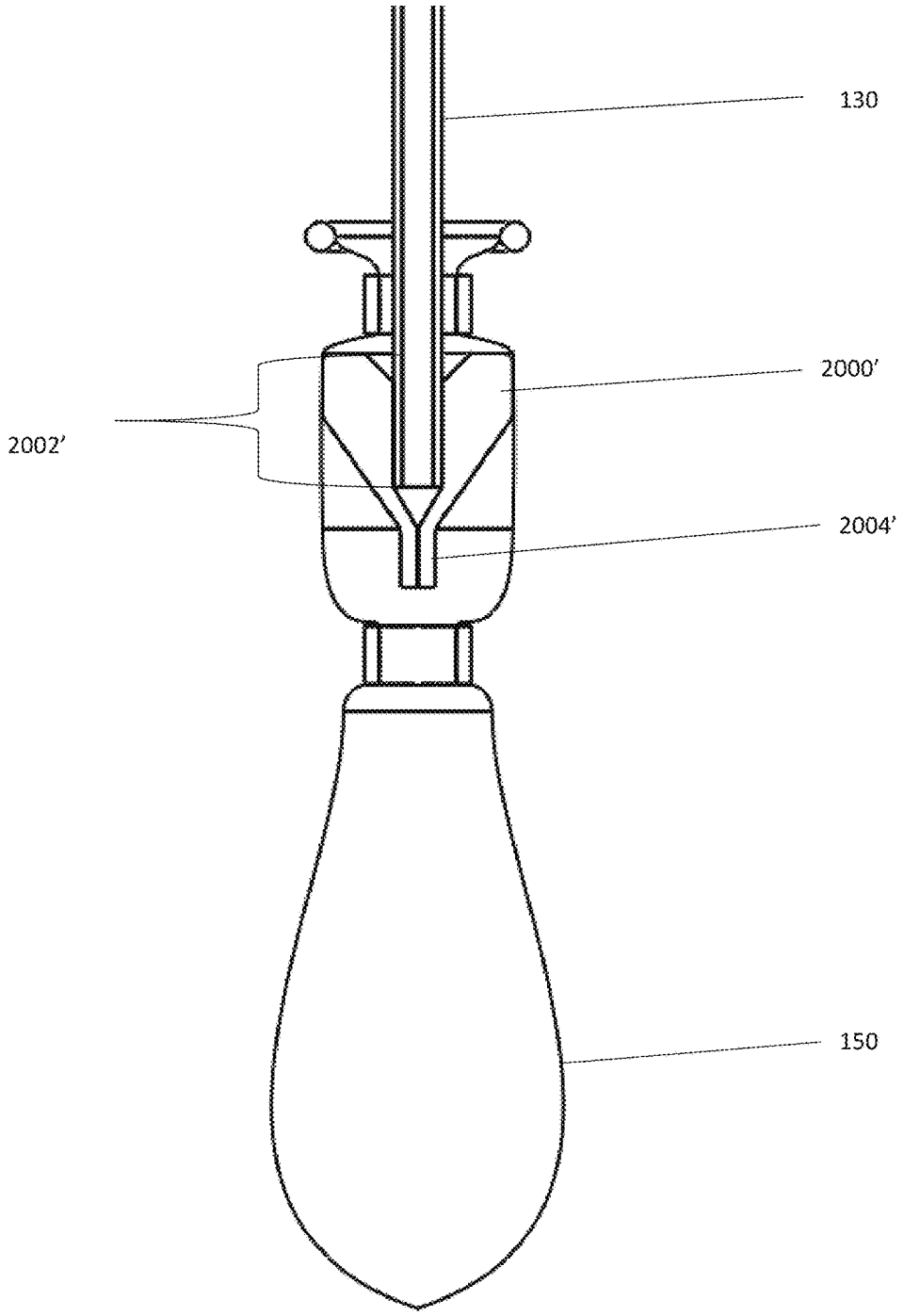
Figure 2C:
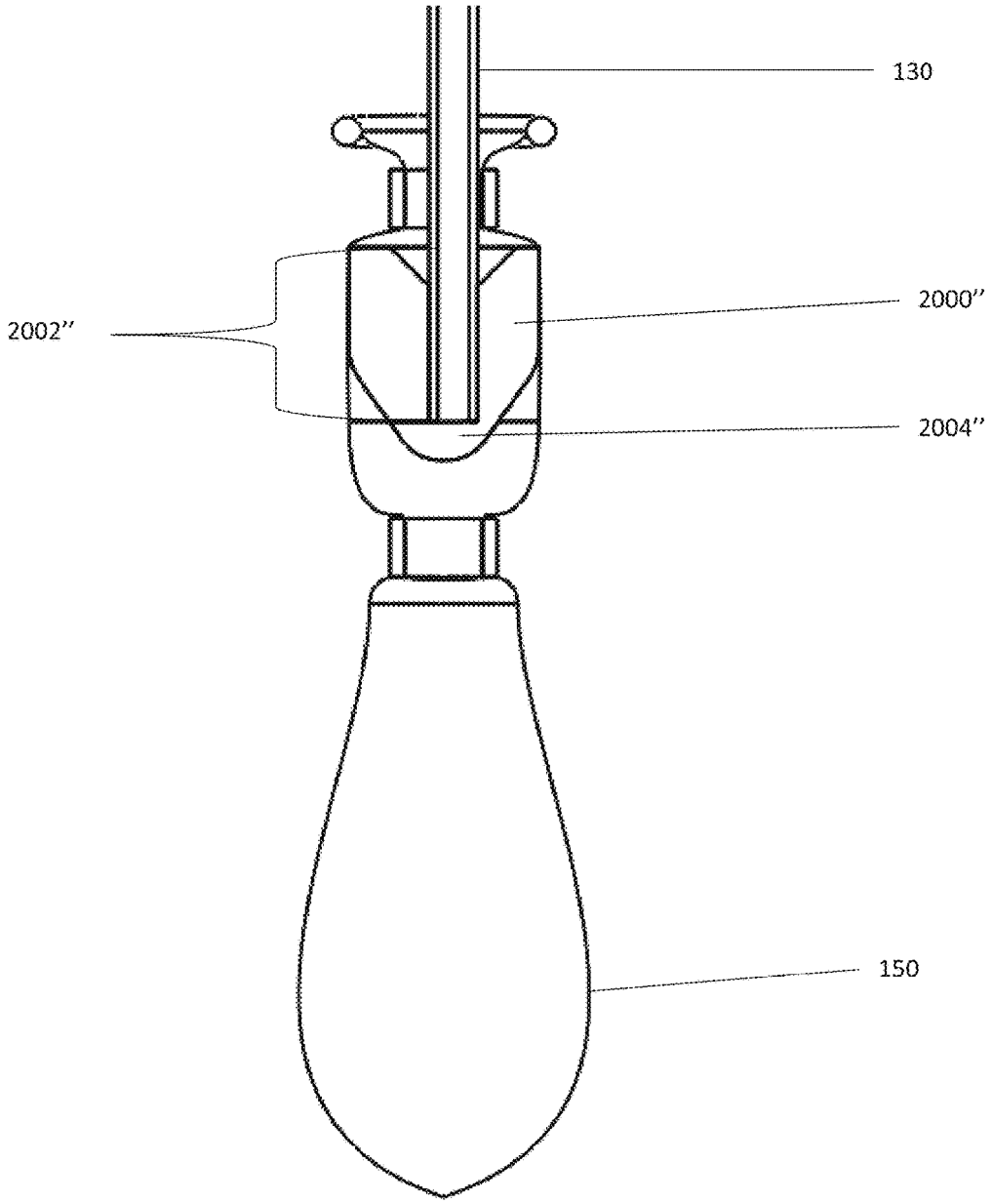

As shown in FIG. 2A, sealing element 140 can include a valve 2000 positioned in the neck of container 150. Valve 2000 can include a channel 2002 and a sealing member 2004, such as a flap. As shown in FIG. 2A, conduit 130 can be received through channel 2002 to allow fluid to fill container 150. According to certain exemplary embodiments, conduit 130 can be positioned in channel 2002 such that a portion of conduit 130 extends beyond a lower surface 2006 so that it maintains sealing member 2004 in an open position while conduit 130 is received in channel 2002. Alternatively, conduit 130 can be positioned so that it does not extend beyond lower surface 2006, and sealing member 2004 is opened by the flow pressure of the fluid filling containers 150 as containers 150 are being filled. Channel 2002 can be sized, shaped, dimensioned, and configured to receive conduit 130 and apply a desired frictional force to ensure that container 150 is coupled to conduit 130 and automatically detaches container 150 from conduit 130 when the weight and/or pressure of container 150 exceeds a certain threshold. For example, the shape, length, dimensions of channel 2002 can be selected to obtain the desired frictional force. For example, the length of the channel (e.g., the longer the channel the greater the frictional force on conduit 130), the diameter of the channel (e.g., a smaller diameter channel would have a greater frictional force), the shape of the channel (e.g., cylindrical, rectangular, triangular, oval-shaped, tapered, having ribs, etc.) can all be adjusted to achieve the desired frictional force. In operation, fluid is introduced to container 150 via conduit 130, and once container 150 reaches the threshold at which it detaches from conduit 130, the pressure within container 150 causes sealing member 2004 to close against lower surface 2006 of valve 2000, thereby sealing container 150. According to certain exemplary embodiments, valve 2000 is made of silicone. Alternatively, valve 2000 can be made of other suitable thermoplastics, rubbers, non-thermoplastic rubbers, etc.

As shown in FIG. 2A, valve 2000 can include ring members 2008 and 2010. Preferably, ring members 2008 and 2010 are substantially rigid, and prevent container 150 from radially expanding at the positions where ring members 2008 and 2010 are positioned. This allows valve 2000 to remain positioned in the neck of container 150 so that it cannot be displaced out of container 150 through the opening or into the main body of container 150 as it expands and is filled with fluid. Alternatively, ring member 2008 and 2010 can be replaced with other mechanisms, components or features that substantially prevent radial expansion of the container, so as to allow valve 2000 to remain positioned in the neck of container 150, such as, for example, a sleeve, an adhesive, etc.

Although valve 2000 shown in FIG. 2A is a reed type valve mechanism, other valves can be employed. For example, as shown in FIG. 2B, sealing element can include a duckbill valve 2000' or a bullet valve 2000" as shown in FIG. 2C. Each of duckbill valve 2000' and bullet valve 2000" operates similarly to valve 2000. Each of duckbill valve 2000' and bullet valve 2000" is configured to be positioned in a neck of container 150 and includes a channel (2002' and 2002", respectively) configured to receive conduit 130 therethrough. Each of duckbill valve 2000' and bullet valve 2000" also includes a sealing members (2004' and 2004") that seals container 150. For example, sealing members 2004' of duckbill valve 2002' can be pressed together to form a seal. Alternatively, another embodiment can provide a valve member including a slit through which conduit 130 is received and the slides/walls of the slit can form a seal when conduit 130 is removed. Although embodiments of the present invention have been described with respect to a reed valve, a bullet valve, and a duckbill valve, other valve mechanisms can be employed where the pressure within container 150 is used to close and seal the valve.

According to certain embodiments of the present invention, sealing elements 140 including valve 2000 can facilitate fluid filling apparatus 100 to be reusable. For example, containers 150, including sealing elements 140 having valve 2000 already inserted in the neck of containers 150, can be provided separate and apart from fluid filling apparatus 100, which can be installed onto fluid filling apparatus 100 by a user. For example, fluid filling apparatus 100 can be provided preassembled with a certain number of containers 150. After a user has used all containers 150 that were initial coupled to fluid filling apparatus 100, replacement containers 150, including sealing elements 140 including valve 2000 already inserted in the neck of containers 150, can be provided, and a user can install containers 150 onto conduits 130 of fluid filling apparatus 100. Accordingly, a user or consumer would not need to purchase the entire fluid filling apparatus 100 again.

Figure 3A:
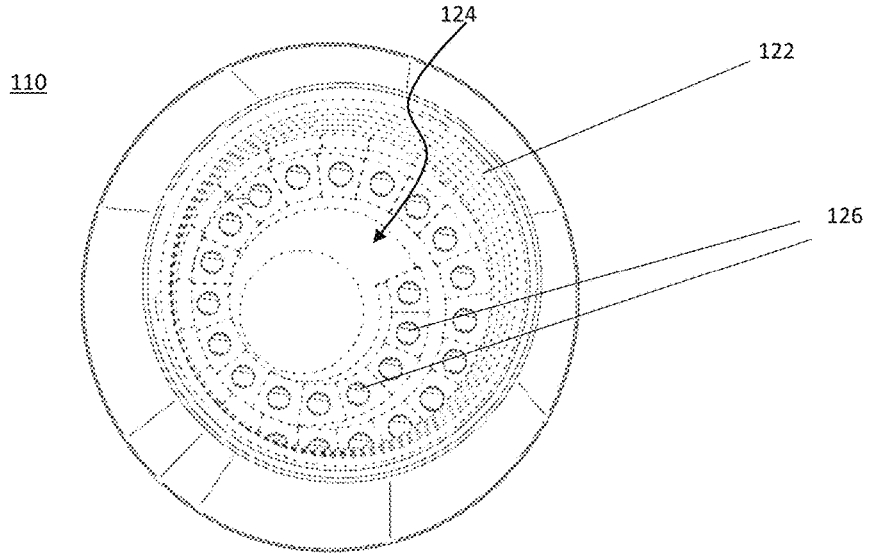
FIGS. 3A and 3B are a perspective views of an exemplary connector according to embodiments of the present invention.
Figure 3B:
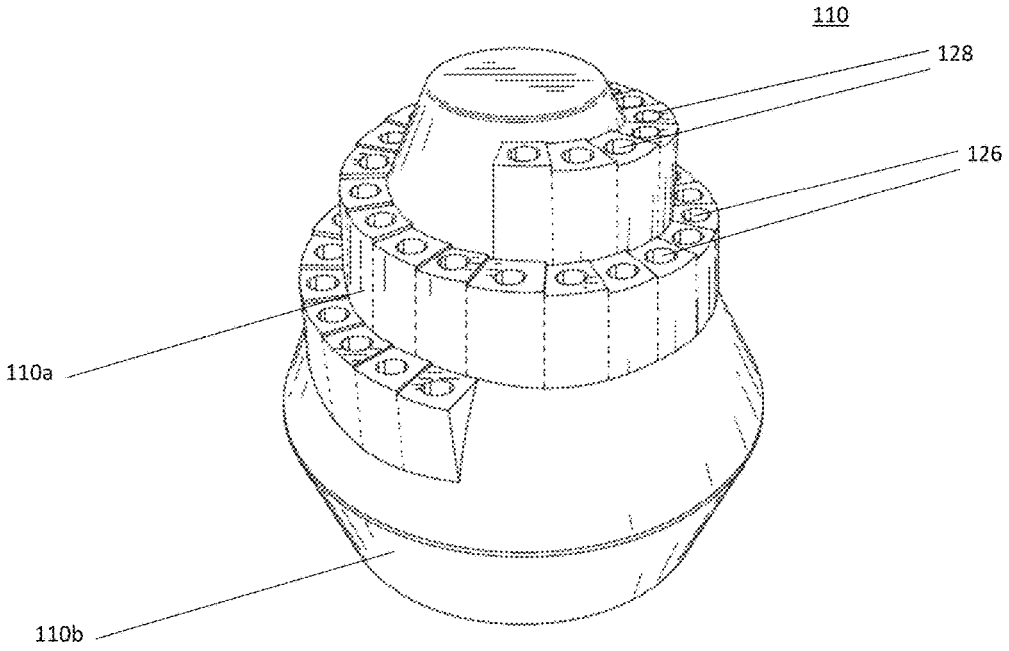

FIGS. 3A and 3B show an exemplary connector 110 according to embodiments of the present invention. As shown in FIGS. 3A and 3B, connector 110 may be substantially cylindrical and may include a first portion 110*a* and a second portion 110*b*. According to certain embodiments, first portion 110*a* and second portion 110*b* may be two distinct components that can be removably or permanently coupled together. Alternatively, according to other embodiments, first portion 110*a* and second portion 110*b* may be formed from a single piece. As shown in FIGS. 3A and 3B, connector 110 includes coupling element 122, flow path 124, and openings/channels 126. Openings/channels 126 may include an interior end and an exterior end and provides fluid communication between the exterior of connector 110 and the interior of connector 110. Further, openings/channels 126 may be dimensioned and sized to receive, or otherwise connect with, conduits 130. Coupling element 122 is configured to removably couple connector 110, and thereby couple fluid filling apparatus 100, to an upstream component, such as a fluid source. Coupling element 122 may include threads, as shown in FIG. 3A, or any other type of clamping or coupling mechanism. Although connector 110 is shown to be substantially cylindrical, connector 110 may take on any shape (e.g., square, rectangular, etc.) that may be desired. Additionally, the shape of connector 110 may differ depending on the type of upstream component that is to be used with connector 110. Further, according to certain exemplary embodiments, second portion 110*b* may be an adapter that enables connector 110 to be coupled to different upstream components. For example, second portion 110*b* may include various different types of coupling element 122 and may removably couple to first portion 110*a* so that connector 110 can be coupled to a variety of upstream components. Further, connector 110 may include features on the exterior to assist a user in actuating coupling element 122 to couple end cap 120 to an upstream component. According to an embodiment of the present invention, coupling element 122 may include standardized threads for receiving the threads of a standard faucet or hose.

As shown in FIG. 3A, flow path 124 and openings/channels 126 may define a flow path that the fluid may follow from the upstream component, such as a fluid source, through connector 110 to conduits 130. Preferably, conduits 130 are received in or otherwise connected to openings/channels 126. Accordingly, fluid entering connector 110 may flow through flow path 124 and through openings/channels 126 to conduits 130. The number and dimensions of the openings/channels 126 correspond to the number and dimensions of conduits 130. According to certain embodiments of the present invention, the number, size, and dimensions of openings/channels 126 may be selected in view of the number of containers 150 to be filled at one time and the speed at which they are to be filled. Accordingly, connector 110 may include any number of openings/channels 126 that is desired. As shown in FIGS. 3A and 3B, according to an embodiment of the present invention, connector 110 may include forty openings/channels 126.

As shown in FIGS. 3A and 3B, openings/channels 126 may be configured in a spiraling helical arrangement. As shown in FIG. 3B, according to an embodiment of the present invention, the exterior of connector 110 may include a plurality of faceted surfaces 128 in a spiraling helical arrangement. The configuration of faceted surfaces 128 may correspond to the position of openings/channels 126 so that the exterior end of openings/channels 126 may be disposed on faceted surfaces 128. Although FIG. 3B is shown as each faceted surface 128 have a single opening/channel 126 disposed therein, alternatively, each faceted surface 128 can have any number of openings/channels 126 disposed therein, and each faceted surface 128 could have a different number of openings/channels 126 disposed therein. For example, each faceted surface 128 could have two openings/channels 126 disposed therein, alternatively, a first stepped surface 128 could have a single opening/channel 126 disposed therein and a second stepped surface could have three openings/channels 126 disposed therein. According to other embodiments, faceted surfaces 128 can be arranged in any configuration or arrangement. Alternatively, connector 110 may not include faceted surfaces 128 and openings/channels 126 may, for example, be disposed in a smooth spiraling helix or in a spiral on a flat exterior surface.

As shown in FIG. 3A, the interior end of openings/channels 126 may also be disposed in a plurality of faceted surfaces disposed in a spiraling helical arrangement in the interior of connector 110 corresponding to the plurality of faceted surfaces 128 disposed on the exterior of connector 110. Alternatively, the interior end of openings/channels 126 may disposed on a flat surface within the interior of connector 110.

Figure 4A:
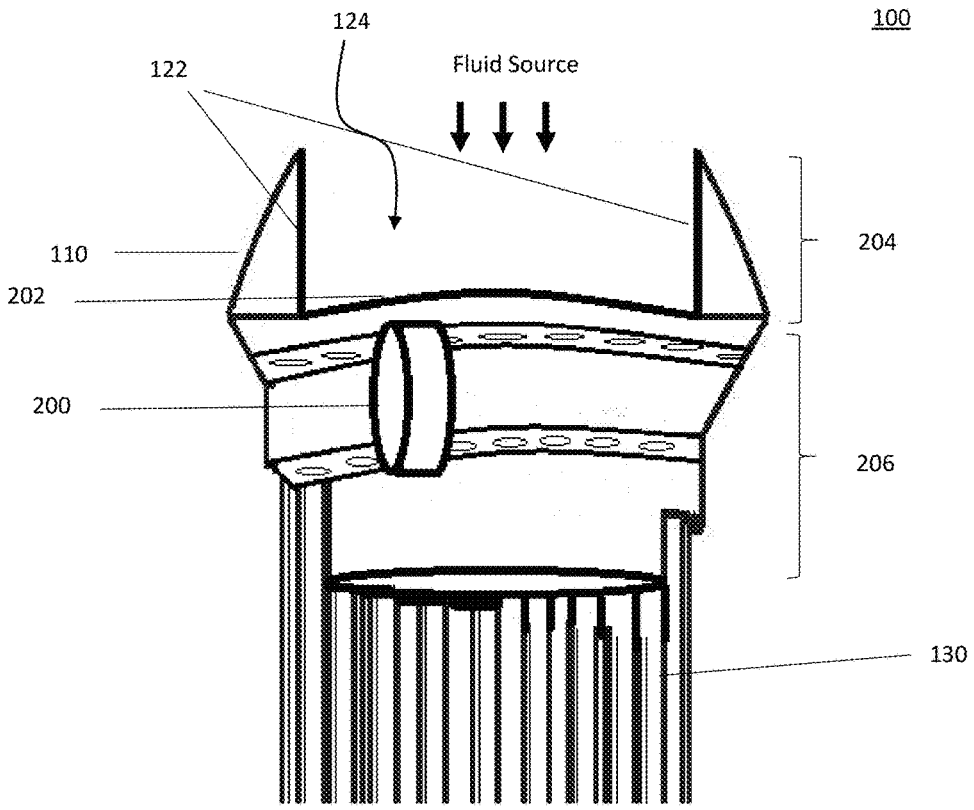
FIG. 4A is a cross-sectional view of an exemplary fluid filling apparatus according to embodiments of the present invention.

FIG. 4A shows a cross sectional view of fluid filling apparatus 100 according to embodiments of the present invention. As shown in FIG. 4A, connector 110 may be substantially cylindrical, and may define a flow path 124. Further, connector 110 preferably includes coupling element 122. Coupling element 122 may include any type of coupling mechanism, such as, e.g., threads or clamps. Coupling element 122 may be configured to couple connector 110 to an upstream component such as a fluid source. According to an embodiment of the present invention, coupling element 122 may include standardized threads for receiving the threads of a standard faucet or hose. Alternatively, coupling elements 122 may include various other types of coupling mechanisms. In operation, connector 110 is preferably coupled to a fluid source via coupling element 122. Once the fluid source is activated, the fluid travels into connector 110, through flow path 124 and into each of the openings/channels 126. The fluid then passes through openings/channels 126 to conduits 130, which are coupled to openings/channels 126. The fluid then passes through conduits 130 to fill containers 150.

As shown in FIG. 4A, connector 110 can include an additive 200 and an additive mixing mechanism. For example, additive mixing mechanism may include a separator 202 which secures additive 200 within the interior of connector 110 and defines two chambers 204 and 206, which are in fluid communication with each other, within the interior of connector 110. Separator 202 secures additive 200 within chamber 206 of the interior of connector 110 during operation of the fluid filling apparatus 100. For example, when the fluid source is activated, the fluid comes into contact with additive 200 in chamber 204 and mixes with additive 200 in chamber 206 and/or chamber 204. The mixture of the additive and the fluid passes through openings/channels 126 to conduits 130, which are coupled to openings/channels 126. The fluid and additive mixture then passes through conduits 130 to fill containers 150. Although additive 200 is shown in pellet form in FIG. 4A, additive 200 may take any form. For example, additive 200 may be in the form of, e.g., a pellet, a powder, or a gel, and may be any material or substance for which a fluid mixture is desired. According to certain exemplary embodiments, additive 200 may include any substance, such as, e.g., soda ash, bicarbonate, lactose, citric acid, mineral oil, or a dye. Additionally, although only one additive 200 is shown in FIG. 4A, any number of additives may be disposed within chamber 206 of connector 110.

Figure 4B:
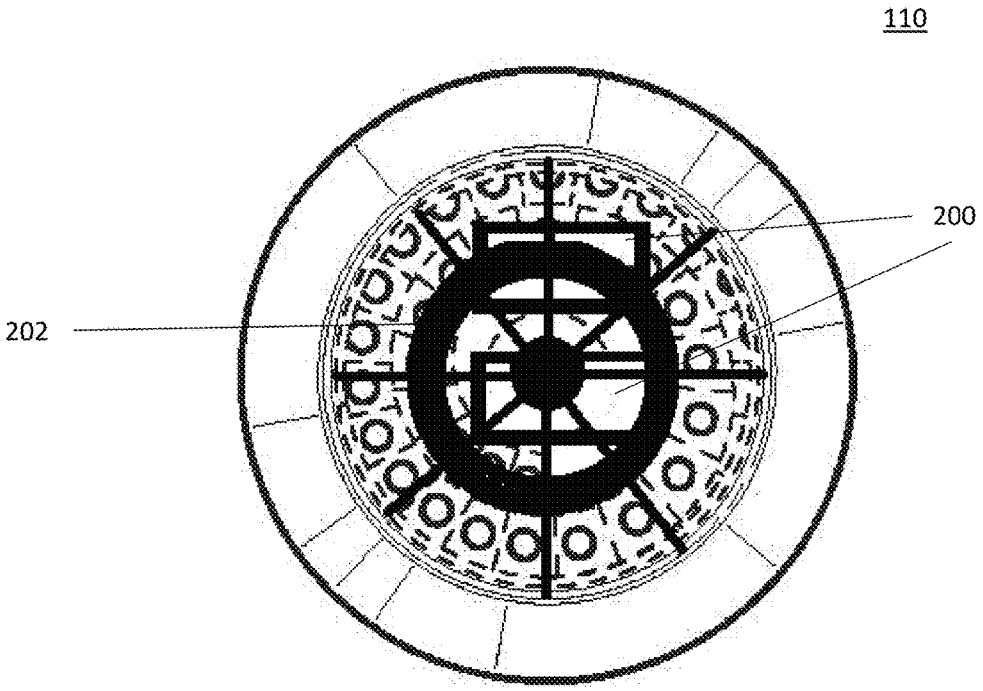
FIG. 4B is a top view of an exemplary fluid filling apparatus according to embodiments of the present invention.

FIG. 4B shows a top-view of connector 110 with the mixing mechanism. As shown in FIG. 4B, connector 110 includes separator 202 and additives 200. Preferably, separator 202 substantially secures additives 200 to the interior of connector 110 so that additives remain within chamber 206 of connector 110 while fluid filling apparatus 100 is in use. Preferably, separator 202 substantially secures additives 200 within chamber 206 of connector 110 even as additives 200 experience turbulence introduced by the fluid flowing through chamber 206. Accordingly, additives 200 substantially remain within chamber 206 while ensuring that chambers 204 and 206 remain in fluid communication with each other. It is contemplated that separator 202 may not secure additive 200 in chamber 206 permanently. For example, as the mixture is being created and additive 200 becomes smaller, portions of additive 200 may become sufficiently small that portions of additive 200 may pass through the portions of separator 202 that provide the fluid communication between chambers 204 and 206 into chamber 204. Although separator 202 is shown in FIG. 4B to have a star configuration with an annular ring and a circular center, separator 202 may include any mechanism that can secure additives 200 within chamber 206 while maintaining fluid communication between chambers 204 and 206. For example, separator 202 can include a mesh, a component with holes or openings in any configuration, etc.

In use, connector 110 may be coupled to a fluid source via coupling element 122. When the fluid source is activated, the fluid flows through flow path 124 of connector 110. The fluid then chamber 206 of connector 110 and interacts with additive 200. As the fluid mixes with additive 200, the mixture exits chamber 206 and enters exits chamber 206 through openings/channels 126. From there, the mixture flows through openings/channels 126 to conduits 130. The mixture then passes through conduits 130 to containers 150, thereby automatically filling containers 150 with a mixture of the fluid and additive 200 in a substantially simultaneous manner.

Figure 5:
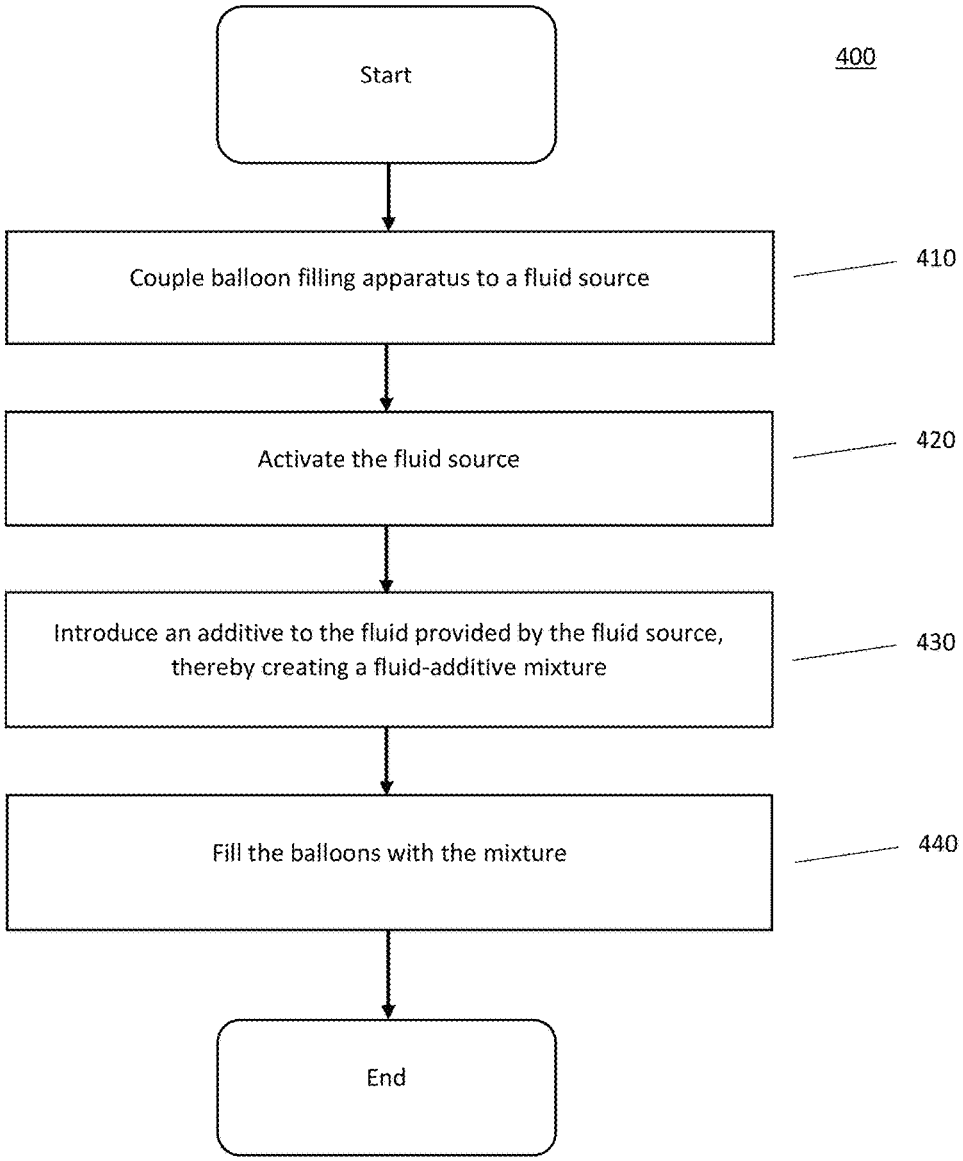
FIG. 5 is a flow diagram of an exemplary method according to embodiments of the present invention.

FIG. 5 shows an exemplary method 400 in accordance with embodiments of the present invention. According to certain embodiments, method 400 may be performed, for example, using fluid filling apparatus 100. As shown in FIG. 5, in step 410, a balloon filling apparatus can be coupled to a fluid source. If method 400 is being performed using fluid filling apparatus 100, this can include coupling connector 110 via coupling elements 122 to a fluid source. In step 420, the fluid source can be activated. In step 430, an additive can be introduced to the fluid provided by the fluid source, thereby creating a fluid-additive mixture. If method 400 is being performed using fluid filling apparatus 100, this can include introducing an additive using a mixing mechanism, such as those described herein. For example, the fluid can come into contact with additive 200 in chamber 204 and mix with additive 200 in chamber 206 and/or chamber 204, thereby creating the fluid-additive mixture. In step 440, the balloons can be filled with the fluid-additive mixture. With respect to fluid filling apparatus 100, after the mixture of the fluid-additive is created, it can pass through openings/channels 126 to conduits 130, which are coupled to openings/channels 126, and then pass through conduits 130 to fill containers 150.

The embodiments and examples shown above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of the disclosure. For a better understanding of the disclosure, reference should be had to the accompanying drawings and descriptive matter in which there is illustrated exemplary embodiments of the present invention.

What is claimed:

1. An apparatus for filling a plurality of containers with a fluid, the apparatus comprising:

a connector configured to removably couple the apparatus to a fluid source;

a flow path providing fluid communication between the fluid source and a plurality of containers coupled to the apparatus;

a sealing element disposed within each of the plurality of containers, the sealing element configured to couple the container to the apparatus and automatically seal the container when the container is decoupled from the apparatus;

a retaining member including a sleeve affixed to each of the plurality of containers, to position the sealing element in a neck of each of the plurality of containers, the sleeve being configured to prevent radial expansion of the containers; and, a mixing mechanism disposed in the flow path and configured to receive an additive and introduce the additive in to the flow path.

2. The apparatus of claim 1, wherein the plurality of containers includes balloons.

3. The apparatus of claim 1, wherein the apparatus is reusable.

4. The apparatus of claim 1, wherein the plurality of fluid conduits are substantially the same length.

5. The apparatus of claim 1, wherein the additive is a pellet, a powder, or a gel.

* * * * *